US010337511B2

(12) United States Patent
Dodel et al.

(10) Patent No.: US 10,337,511 B2
(45) Date of Patent: Jul. 2, 2019

(54) HYDRAULIC CONVEYING DEVICE AND HYDRAULIC SYSTEM

(71) Applicant: Mahle International GmbH, Stuttgart (DE)

(72) Inventors: Peter Dodel, Sonneberg (DE); Marco Kirchner, Auengrund/OTPoppenwind (DE); Michael Langer, Bad Rodach (DE); Christian Richter, Schleusingen (DE)

(73) Assignee: Mahle International GmbH (DE)

( * ) Notice: Subject to any disclaimer, the term of this patent is extended or adjusted under 35 U.S.C. 154(b) by 802 days.

(21) Appl. No.: 14/818,910

(22) Filed: Aug. 5, 2015

(65) Prior Publication Data

US 2016/0040665 A1 Feb. 11, 2016

(30) Foreign Application Priority Data

Aug. 6, 2014 (DE) ..... 10 2014 215 597

(51) Int. Cl.
*F04C 14/22* (2006.01)
*F04C 2/332* (2006.01)
*F04C 2/344* (2006.01)

(52) U.S. Cl.
CPC ..... *F04C 14/226* (2013.01); *F04C 2/332* (2013.01); *F04C 2/344* (2013.01); *F04C 2/3442* (2013.01);
(Continued)

(58) Field of Classification Search
CPC ..... F04C 14/226; F04C 14/22; F04C 2/332; F04C 2/344; F04C 2/3442; F04C 2270/185
See application file for complete search history.

(56) References Cited

U.S. PATENT DOCUMENTS 9,841,020 B2 * 12/2017 Ammon ..... F04C 14/22
2013/0343940 A1 * 12/2013 Ammon ..... F04C 14/22 418/27

(Continued)

FOREIGN PATENT DOCUMENTS

DE 102006039698 B3 10/2007
DE 102010041550 A1 3/2012

(Continued)

*Primary Examiner* — Peter J Bertheaud
(74) *Attorney, Agent, or Firm* — Fishman Stewart PLLC

(57) ABSTRACT

A hydraulic conveying device for an internal combustion engine may include a pendulum slide pump including an inner rotor drivingly connected to an outer rotor via a plurality of pendulum slides. A hydraulic actuation device may change an eccentricity between the inner rotor and the outer rotor via an actuation member. The actuation member may be prestressed by a spring device. The actuation device may further include a first pressure-setting chamber and a second pressure-setting chamber for adjusting the actuation member. At least one of the first pressure-setting chamber and the second pressure-setting chamber may be connected via a control valve to a pressure side of the pendulum slide pump. A hydraulic line may connect the pendulum slide cell pump downstream to a hydraulic medium filter. The control valve may be connected to the hydraulic line upstream of the hydraulic medium filter.

20 Claims, 4 Drawing Sheets

(52) U.S. Cl.
CPC ..... *F04C 14/22* (2013.01); *F04C 14/223* (2013.01); *F04C 2210/206* (2013.01); *F04C 2270/185* (2013.01)

(56) References Cited

U.S. PATENT DOCUMENTS

| | | | |
|---|---|---|---|
| 2014/0072456 | A1 | 3/2014 | Watanabe et al. |
| 2014/0072458 | A1 | 3/2014 | Watanabe |

FOREIGN PATENT DOCUMENTS

| | | | |
|---|---|---|---|
| DE | 10201321648 | A1 | 3/2014 |
| DE | 102013217790 | A1 | 3/2014 |

* cited by examiner

HYDRAULIC CONVEYING DEVICE AND HYDRAULIC SYSTEM

CROSS-REFERENCE TO RELATED APPLICATIONS

This application claims priority to German Patent Application No. 10 2014 215 597.5, filed Aug. 6, 2014, the contents of which are hereby incorporated by reference in their entirety.

TECHNICAL FIELD

The present invention relates to a hydraulic conveying device, in particular an oil-conveying device, preferably for an internal combustion engine. The invention also relates to a hydraulic system which is equipped with such a hydraulic conveying device, preferably for an internal combustion engine, in particular of a motor vehicle.

BACKGROUND

DE 10 2010 041 550 A1 discloses a hydraulic conveying device, which has a pendulum slide cell pump, in which an inner rotor is drive-connected to an outer rotor by means of pendulum slides. The known hydraulic conveying device is also equipped with a hydraulic actuation device for changing an eccentricity between inner rotor and outer rotor, which actuation device has an actuation member for adjusting the eccentricity. The actuation member is also prestressed by means of a spring device for setting a maximum eccentricity.

Such hydraulic conveying devices can be used in motor vehicles in order to drive a hydraulic working medium, preferably oil, in a hydraulic system of the vehicle. For general improvement, it is desirable to keep the number of parts in such a hydraulic system as low as possible and in addition to ensure fast control of the hydraulic conveying device so that it can be adapted quickly to different requirements.

SUMMARY

The present invention is therefore concerned with the problem of specifying an improved embodiment for a hydraulic conveying device of the above-described type, which in particular has a comparatively simple and compact structure and fast responsiveness.

This problem is solved according to the invention by the subject matter of the independent claim(s). Advantageous embodiments form the subject matter of the dependent claims.

The invention is based on the general concept of providing a hydraulic actuation device for changing an eccentricity between inner rotor and outer rotor in a hydraulic conveying device, in particular an oil-conveying device, for controlling a pendulum slide cell pump, wherein according to the invention a first pressure-setting chamber and/or a second pressure-setting chamber is hydraulically connected, controlled by a control valve, to the pressure side of the pendulum slide cell pump and hydraulically counteracts a spring device, which prestresses the pendulum slide cell pump into its maximum output. The pendulum slide cell pump is connected downstream via a hydraulic line to a hydraulic medium filter, the control valve being pressure-connected upstream of the hydraulic medium filter to the hydraulic line. An internal and particularly fast regulation and responsiveness of the pendulum slide cell pump can be achieved thereby, since the regulation pressure on the pump outlet side is applied directly to at least one pressure-setting chamber. The pendulum slide cell pump can thereby react to excessively high pressures within a very short time (overpressure function or cold start function) and in addition no separate cold start valve is necessary. This reduces the number of different parts and as a result the production costs.

According to an advantageous embodiment, the control valve can be configured as a proportional valve. A proportional valve makes almost any intermediate positions between an open position and a closed position possible. The proportional valve thus makes any intermediate positions possible in order to transmit the pressure of the pressure side of the pendulum slide cell pump more or less throttled to the first and/or second pressure-setting chamber. Virtually any desired pressures can be set in the two pressure-setting chambers.

In a further advantageous embodiment of the solution according to the invention, the pendulum slide cell pump and the control valve form a common assembly. This realises considerable installation space advantages and in addition short transmission distances, as a result of which cost and competitive advantages can also be achieved.

According to another advantageous embodiment, the control valve can be configured as a 3/2-way valve, the first connection thereof being hydraulically connected to the pressure side of the pendulum slide cell pump upstream of the hydraulic medium filter, the second connection thereof being hydraulically connected to the second pressure-setting chamber, and the third connection thereof being hydraulically connected to a hydraulic reservoir. The first pressure-setting chamber is permanently hydraulically connected to the pressure side of the pendulum slide cell pump and hydraulically counteracts the spring device. When in a first end position (open position), the control valve can thus couple the first connection to the second connection, so that the pressure side of the pendulum slide cell pump is connected to the second pressure-setting chamber. In a second end position (closed position), the second connection is connected to the third connection, so that the second pressure-setting chamber is connected to the hydraulic reservoir. The configuration of the 3/2-way valve as a proportional valve means that virtually any desired intermediate positions can be realised between the two end positions, so the pressure in the second pressure-setting chamber can be set as desired between the pressure on the pressure side of the pendulum slide cell pump and the pressure in the hydraulic reservoir. Ambient pressure, that is atmospheric pressure, prevails in the pressureless or atmospheric hydraulic reservoir, for example.

Alternatively, the control valve can likewise be configured as a 3/2-way valve, the first connection thereof being hydraulically connected to the pressure side of the pendulum slide cell pump upstream of the hydraulic medium filter, the second connection thereof being hydraulically connected to the first pressure-setting chamber, and the third connection thereof being hydraulically connected to the hydraulic reservoir. In this case, the second pressure-setting chamber is permanently hydraulically connected to the pressure side of the pendulum slide cell pump and hydraulically counteracts the spring device. When in a first end position (open position), the control valve can thus couple the first connection to the second connection, so that the pressure side of the pendulum slide cell pump is connected to the first pressure-setting chamber. In a second end position (closed position), the second connection is connected to the third connection, so that the first pressure-setting chamber is connected to the hydraulic reservoir. In this case too, virtually any desired intermediate positions can be realised between the two end positions, so the pressure in the first pressure-setting chamber can be set as desired between the pressure on the pressure side of the pendulum slide cell pump and the pressure in the hydraulic reservoir.

In another alternative, the control valve is formed as a regulating piston, an external control valve also being provided, which is configured as a 3/2-way valve, the first connection thereof being hydraulically connected to the pressure side of the pendulum slide cell pump downstream of the hydraulic medium filter, the second connection thereof being hydraulically connected to the regulating piston, and the third connection thereof being hydraulically connected to a hydraulic reservoir. The regulating piston is hydraulically connected upstream of the hydraulic medium filter to the pressure side of the pendulum slide cell pump via a first connection, to the first and second pressure-setting chambers via second and third connections, and to the connection of the control valve via fourth and fifth connections. In this embodiment, both pressure-setting chambers are switched together. There is a control pressure, which is tapped off downstream of the hydraulic medium filter and can be switched by the external control valve. This control pressure does not go directly into the pressure-setting chambers but is conducted through the regulating piston (pilot piston). However, this pilot piston is also actuated by the internal pressure (control pressure at the output of the pendulum slide cell pump upstream of the hydraulic medium filter). This regulating piston can thus act as a fail-safe and cold-start regulation system.

A common feature of all the embodiments is that pump internal or output pressure is applied to at least one pressure-setting chamber. The pendulum slide cell pump can thereby react to excessively high pressures within a very short time (overpressure function or cold start function). Moreover, a separate cold start valve is not necessary (→potential for savings). In traditional regulation with main oil duct pressure, the pressure signal takes too long in the cold state owing to the high viscosity. A separate cold start valve is therefore necessary to limit the pressure and avoid component damage.

According to another advantageous embodiment, the actuation member can be formed by a stator, in which the outer rotor is rotatably arranged and which can be pivotably adjusted in a housing of the actuation device about a pivot axis running parallel and eccentrically to the rotation axis of the inner rotor, the rotation axis of the inner rotor being arranged in a stationary or positionally fixed manner in relation to the housing. For example, a shaft running coaxially to the rotation axis of the inner rotor can be fastened to the housing such that the inner rotor can then be rotatably mounted to said shaft. Alternatively, said shaft can also be mounted rotatably on the housing, the inner rotor then being arranged in a rotationally fixed manner on said shaft. The configuration of the actuation member as a stator in which the outer rotor can be pivoted relative to the inner rotor eccentrically to the rotation axis of the inner rotor, produces an extremely compact design for the actuation device.

As a result of this design, the actuation device is structurally integrated into the pendulum slide cell pump, since the stator of the pendulum slide cell pump mounts the outer rotor of the pendulum slide cell pump and also forms the actuation member of the actuation device.

Additionally or alternatively, the second pressure-setting chamber can be arranged in the housing distally from the pivot axis. As a result of this measure, the pressure forces that can be generated in the second pressure-setting chamber have a comparatively large lever arm for driving the actuation member. Even smaller pressure forces can thus also be used for generating significant actuation forces for adjusting the actuation member stator.

Additionally or alternatively, the spring device can be arranged in the housing distally from the pivot axis. As a result of this measure, the spring device also has a comparatively large lever arm. However, a comparatively large spring lift is also realised thereby for the spring device, so for example enough installation space for a linear spring characteristic can be realised for the spring device.

In another advantageous embodiment, the spring device can have at least one compression spring, for example a helical compression spring, via which the stator is supported on the housing. An embodiment that is compact and can be realised simply is also supported thereby.

Further important features and advantages of the invention can be found in the subclaims, the drawings and the associated description of the figures using the drawings.

It is self-evident that the above-mentioned features and those still to be explained below can be used not only in the combination given in each case but also in other combinations or alone without departing from the scope of the present invention.

Preferred exemplary embodiments of the invention are shown in the drawings and are explained in more detail in the description below, the same reference symbols referring to the same or similar or functionally equivalent components.

BRIEF DESCRIPTION OF THE DRAWINGS

In the figures.

DETAILED DESCRIPTION

Figure 1:
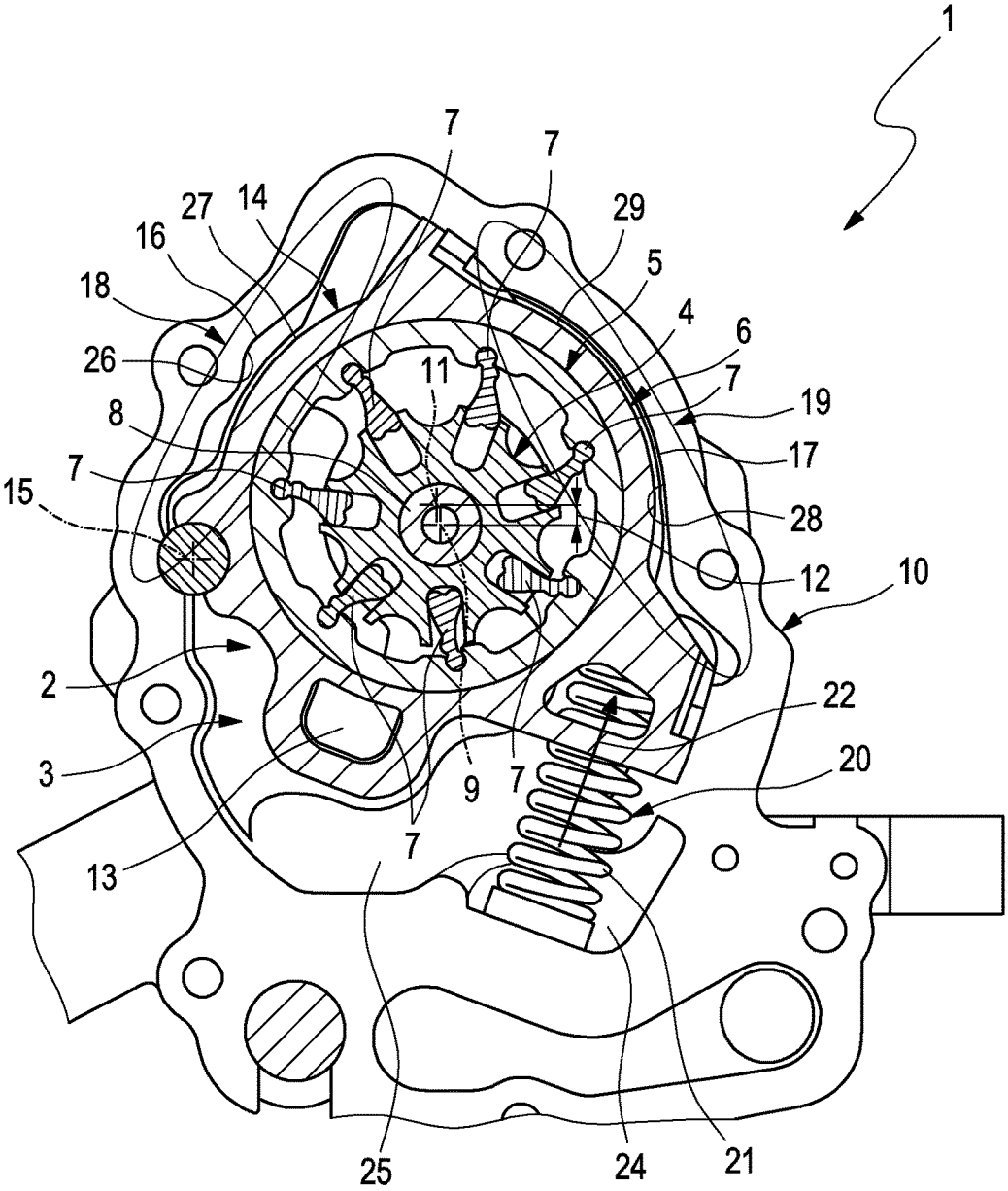
FIG. 1 schematically shows a sectional view of a hydraulic conveying device.

According to FIG. 1, a hydraulic conveying device 1, which can preferably be an oil-conveying device, comprises a pendulum slide cell pump 2 and a hydraulic actuation device 3. The pendulum slide cell pump 2 comprises an inner rotor 4, an outer rotor 5 and a stator 6. The outer rotor 5 is mounted rotatably in the stator 6. The outer rotor 5 is drive-connected to the inner rotor 4 via a plurality of pendulum slides 7. The inner rotor 4 is also arranged concentrically to a shaft 8, which extends coaxially to a rotation axis 9. The rotation axis 9 or the shaft 8 is arranged in a positionally fixed or stationary manner in relation to a housing 10 of the device 1. The shaft 8 can be fastened to the housing 10, the inner rotor 4 then being mounted rotatably on the shaft 8. Alternatively, the inner rotor 4 can also be connected to the shaft 8 in a rotationally fixed manner, the shaft 8 then being mounted rotatably on the housing 10. In both cases, the rotation axis 9 is stationary or positionally fixed in relation to the housing 10. However, the shaft 8 is preferably mounted rotatably on the housing 10, as a result of which it is in particular possible to use the shaft 8 as a drive shaft for driving the inner rotor 4. In principle, however, a different embodiment is also conceivable. For example, the outer rotor 5 and the stator 6 can interact in the manner of an electric motor, to which end corresponding electromagnetic coils (not shown here) can be arranged on the stator 6, while permanent magnets (likewise not shown) can be present on the outer rotor 5.

The outer rotor 5 has a longitudinal centre axis 11, which is arranged eccentrically to the rotation axis 9, which is arranged concentrically to the inner rotor 4, and correspondingly has an eccentricity 12 in the state of FIG. 1. In such a pendulum slide cell pump 2, the size of this eccentricity 12 determines the output and achievable pressure on the pressure side 13 of the pendulum slide cell pump 2. The larger the eccentricity 12, the greater the achievable pressure.

The eccentricity 12 between inner rotor 4 and outer rotor 5 can then be set, that is, changed with the aid of the hydraulic actuation device 3, in order in this manner to vary or set the pressure on the pressure side 13 that can be generated with the aid of the pendulum slide cell pump 2. To this end, the actuation device 3 has an actuation member 14, with the aid of which the relative position between outer rotor 5 and inner rotor 4 can be changed. Specifically, the position of the outer rotor 5 with respect to the housing 10 can be changed with the aid of the actuation member 14. Since the inner rotor 4 is arranged in a positionally fixed manner in relation to the housing 10 by means of the shaft 8, a change in the relative position between outer rotor 5 and housing 10 results in a change in the relative position between outer rotor 5 and inner rotor 4, as a result of which the eccentricity 12 changes.

In the preferred embodiment shown in FIG. 1, the actuation member 14 is substantially formed by the stator 6 of the pendulum slide cell pump 2. When the relative position of the stator 6 in the housing 10 is changed, the outer rotor 5 mounted therein is necessarily also adjusted relative to the housing 10. The stator 6 or actuation member 14 is mounted on the housing 10 such that it can be pivotably adjusted about a pivot axis 15. This pivot axis 15 runs parallel and eccentrically to the rotation axis 9 of the inner rotor 4.

The actuation device 3 comprises a first pressure-setting chamber 16 and a second pressure-setting chamber 17. Both pressure-setting chambers 16, 17 act to adjust the actuation member 14. In FIG. 1, a first chamber region 18, in which the first pressure-setting chamber 16 is formed, is indicated by an ellipse. In FIG. 1, a second chamber region 19, in which the second pressure-setting chamber 17 is formed, is also indicated by a further ellipse. The actuation device 3 furthermore comprises a spring device 20, which is supported on the housing 10 on one side and on the stator 6 on the other side and prestresses the stator 6 into a position in which a maximum eccentricity 12 is present. In the example shown in FIG. 1, the spring device 20 generates a compressive force. The spring device 20 is also realised by way of example with a helical compressive spring 21 here.

The first pressure-setting chamber 16 is arranged such that the pressure forces prevailing therein drive the actuation member 14 counter to a spring force 22, which is indicated in FIG. 1 by an arrow. The second pressure-setting chamber 17 is likewise arranged such that the pressures prevailing therein counteract the spring force 22 of the spring device 20.

In the example of FIG. 1, the spring device 20 is arranged in a counterpressure chamber 24. In the embodiment shown in FIG. 1, the first pressure-setting chamber 16 is arranged in the housing 10 proximally to the pivot axis 15. In contrast, the second pressure-setting chamber 17 and the spring device 20 and the counterpressure chamber 24 are arranged in the housing 10 distally from the pivot axis 15. It is also provided in the embodiment shown here for the first pressure-setting chamber 16 to be delimited directly by a first inner wall section 26 of the housing 10 and a first outer wall section 27 of the stator 6. Furthermore, the second pressure-setting chamber 17 is delimited directly by a second inner wall section 28 of the housing 10 and a second outer wall section 29 of the stator 6. The compression spring 21 used to realise the spring device 20 supports the stator 6 on the housing 10.

According to the invention, the first pressure-setting chamber 16 (cf. FIG. 3), the second pressure-setting chamber 17 (cf. FIG. 2) or both pressure-setting chambers 16, 17 (cf. FIG. 4) is/are hydraulically connected to the pressure side 13 of the pendulum slide cell pump 2, controlled by a control valve 23, and hydraulically counteract(s) the spring device 20. The pendulum slide cell pump 2 is also connected downstream via a hydraulic line 43 to a hydraulic medium filter 42, the control valve 23 being pressure-connected upstream of the hydraulic medium filter 42 to the hydraulic line 43.

Figure 2:
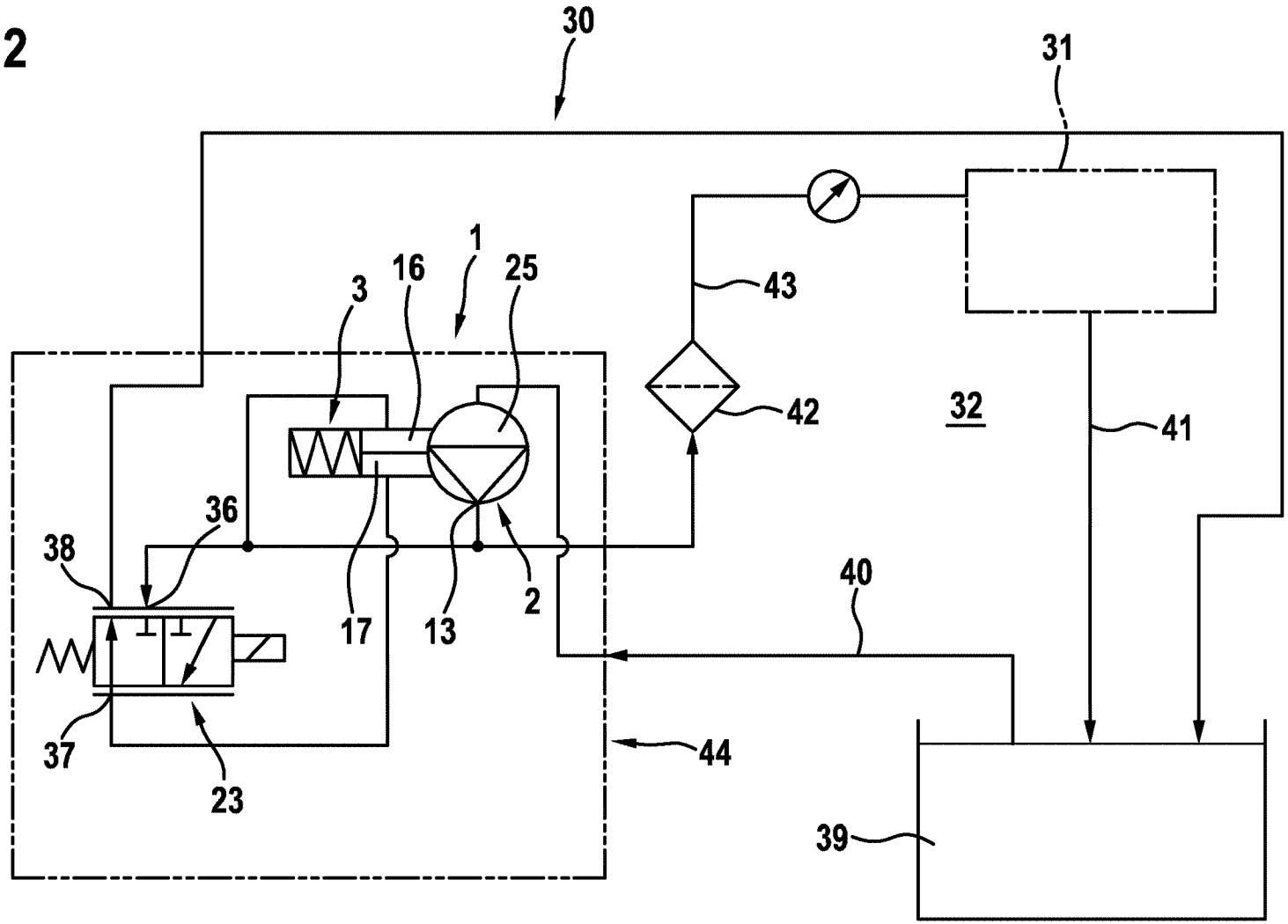
FIGS. 2 to 4 shows circuit-diagram-like schematic diagrams of a hydraulic system in different embodiments.
Figure 3:
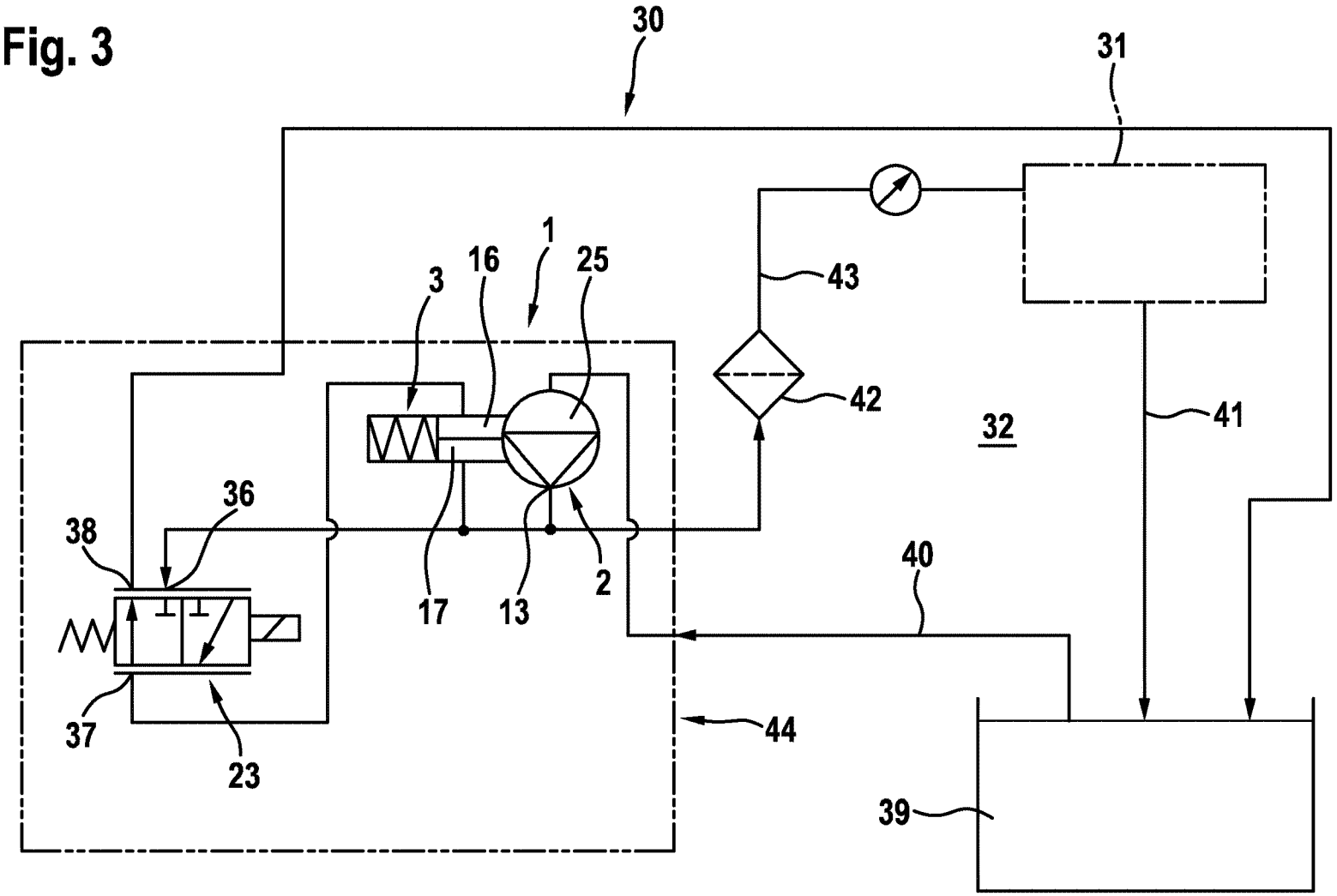
Figure 4:
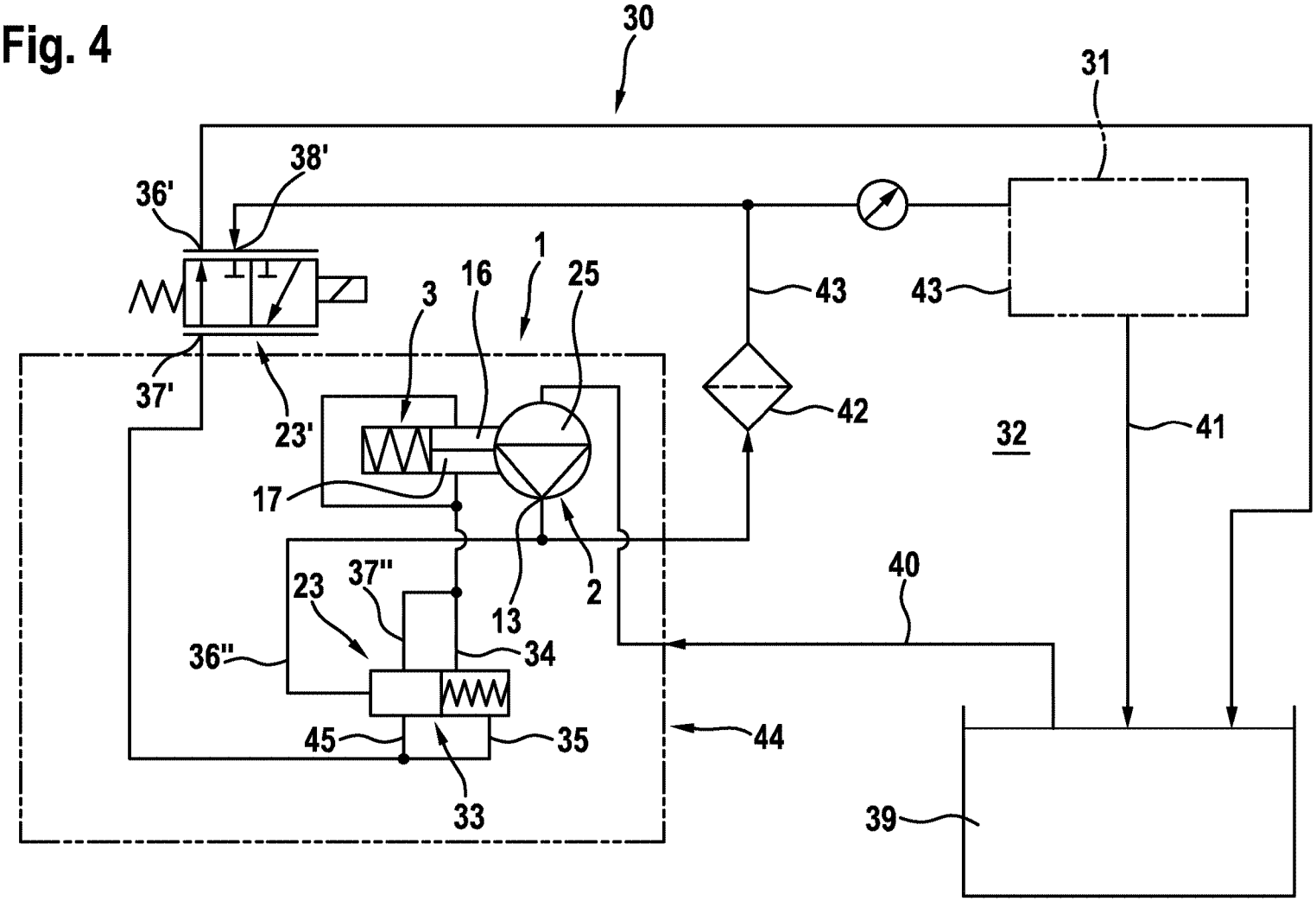

According to FIGS. 2 to 4, a hydraulic system 30 comprises the hydraulic conveying device 1, the hydraulic medium filter 42 and a hydraulic reservoir 39. The hydraulic system 30 for example supplies an engine 31 of a motor vehicle 32.

In the embodiments shown in FIGS. 2 and 3, the control valve 23 is a proportional valve. Furthermore, the control valve 23 is a 3/2-way valve.

In the embodiment according to FIG. 2, the first pressure-setting chamber 16 is hydraulically connected permanently to the pressure side 13 of the pendulum slide cell pump 2 and hydraulically counteracts the spring device 20. The first connection 36 of the control valve 23 is hydraulically connected to the pressure side 13 of the pendulum slide cell pump 2 upstream of the hydraulic medium filter 42, whereas the second connection 37 thereof is hydraulically connected to the second pressure-setting chamber 17 and the third connection 38 thereof is hydraulically connected to the hydraulic reservoir 39. A suction line 40 leads from the hydraulic reservoir 39 to the intake side 25 of the pendulum slide cell pump 2. A return line 41 also leads back from the engine 31 to the reservoir 39.

In the embodiment shown in FIG. 3, the second pressure-setting chamber 17 is hydraulically connected permanently to the pressure side 13 of the pendulum slide cell pump 2 and consequently hydraulically counteracts the spring device 20. In this embodiment, the second connection 37 is hydraulically connected to the first pressure-setting chamber 16 and the third connection 38 thereof is hydraulically connected to the hydraulic reservoir 39.

The hydraulic system 30 according to FIG. 4, in which the control valve 23 is formed as a regulating piston 33, is formed as an alternative to this. In addition, an external control valve 23' is provided, which is configured as a 3/2-way valve and the first connection thereof 36' is hydraulically connected to the pressure side 13 of the pendulum slide cell pump 2 downstream of the hydraulic medium filter 42, whereas the second connection 37' thereof is hydraulically connected to the regulating piston 33 and the third connection 38' is hydraulically connected to the hydraulic reservoir 39.

The regulating piston 33 is hydraulically connected with a first connection 36" to the pressure side 13 of the pendulum slide cell pump 2 upstream of the hydraulic medium filter 42 and via second and third connections 37", 34 to the first and second pressure-setting chambers 16, 17 at the same time. The regulating piston 33 is connected to the second connection 37' of the external control valve 23' via fourth and fifth connections 35, 45.

It can generally be provided for the pendulum slide cell pump 2 and the control valve 23 to form a common assembly 44. It is clear that in principle any desired intermediate positions can also be set between the end positions with the aid of the proportional valve 23, so basically any pressure can be set between the pressure of the pressure side 13 and the pressure of the intake side 25 or of the reservoir 39.

A feature common to all the embodiments is that pump internal or output pressure is applied to at least one pressure-setting chamber 16, 17, as a result of which the pendulum slide cell pump 2 can react to excessively high pressures within a very short time (overpressure function or cold start function). Moreover, a separate cold start valve is not necessary (→potential for savings).

The invention claimed is:

1. A hydraulic conveying device for an internal combustion engine, comprising:

a pendulum slide cell pump including an inner rotor drivingly connected to an outer rotor via a plurality of pendulum slides, the pendulum slide cell pump having an intake side and a pressure side, a hydraulic actuation device for changing an eccentricity between the inner rotor and the outer rotor the actuation device including an actuation member for adjusting the eccentricity, a hydraulic reservoir downstream of a hydraulic medium filter, the actuation member being prestressed via a spring device to define a maximum eccentricity, the actuation device further including a first pressure-setting chamber and a second pressure-setting chamber for adjusting the actuation member, wherein at least one of the first pressure-setting chamber and the second pressure-setting chamber is hydraulically connected via a control valve to the pressure side of the pendulum slide cell pump, the at least one of the first pressure-setting chamber and the second pressure-setting chamber hydraulically counteracting the spring device, wherein the pressure side of the pendulum slide cell pump is connected downstream to the hydraulic medium filter via a first hydraulic line and the hydraulic medium filter is located between the pressure side of the pendulum slide cell pump and the hydraulic reservoir, and the control valve is pressure-connected to the first hydraulic line upstream of the hydraulic medium filter.

2. The device according to claim 1, wherein the pendulum slide cell pump and the control valve form a common assembly.

3. The device according to claim 1, wherein:

the first pressure-setting chamber is hydraulically connected to the pressure side of the pendulum slide cell pump and hydraulically counteracts the spring device, and the control valve is configured as a 3/2-way valve including a first connection hydraulically connected to the pressure side of the pendulum slide cell pump upstream of the hydraulic medium filter, a second connection hydraulically connected to the second pressure-setting chamber, and a third connection hydraulically connected to a hydraulic reservoir.

4. The device according to any one of claim 1, wherein:

the second pressure-setting chamber is hydraulically connected to the pressure side of the pendulum slide cell pump and hydraulically counteracts the spring device, and the control valve is configured as a 3/2-way valve including a first connection hydraulically connected to the pressure side of the pendulum slide cell pump upstream of the hydraulic medium filter, a second connection hydraulically connected to the first pressure-setting chamber, and a third connection hydraulically connected to a hydraulic reservoir.

5. The device according to claim 1, wherein:

the control valve is a regulating piston, and further including an external control valve configured as a 3/2-way valve including a first connection hydraulically connected to the pressure side of the pendulum slide cell pump downstream of the hydraulic medium filter, a second connection hydraulically connected to the regulating piston, and a third connection hydraulically connected to a hydraulic reservoir.

6. The device according to claim 5, wherein the regulating piston has a plurality of connections including:

a first connection hydraulically connected to the pressure side of the pendulum slide cell pump upstream of the hydraulic medium filter, a second connection connected to the first pressure-setting chamber and a third connection connected to the second pressure-setting chamber, and a fourth connection and a fifth connection each connected to the second connection of the external control valve.

7. The device according to claim 1, wherein the actuation member includes a stator and the outer rotor is arranged rotatably within the stator, and wherein the stator is adjustably mounted in a housing in a pivotable manner about a pivot axis extending parallel and eccentrically to a rotation axis of the inner rotor, the rotation axis being arranged in a stationary relationship with respect to the housing.

8. The device according to claim 7, wherein at least one of:

the first pressure-setting chamber is arranged in the housing proximally to the pivot axis, the second pressure-setting chamber is arranged in the housing distally from the pivot axis, and the spring device is arranged in the housing distally from the pivot axis.

9. The device according to claim 3, wherein the hydraulic reservoir is connected via a second hydraulic line to the intake side and without passing through a filter.

10. A hydraulic system of a motor vehicle, comprising: a hydraulic conveying device for supplying a hydraulic medium, the hydraulic conveying device including:

a pendulum slide cell pump including an inner rotor drivingly connected to an outer rotor via a plurality of pendulum slides, the pendulum slide cell pump having an intake side and a pressure side;

a hydraulic actuation device for changing an eccentricity between the inner rotor and the outer rotor, the actuation device including an actuation member for adjusting the eccentricity, wherein the actuation member is prestressed via a spring device to define a maximum eccentricity;

a hydraulic reservoir downstream of a hydraulic filter medium;

the actuation device further including a first pressure-setting chamber and a second pressure-setting chamber for adjusting the actuation member, wherein at least one of the first pressure-setting chamber and the second pressure-setting chamber is hydraulically connected via a control valve to the pressure side of the pendulum slide cell pump, and wherein the at least one of the first pressure-setting chamber and the second pressure-setting chamber hydraulically counteracts the spring device;

wherein the pressure side of the pendulum slide cell pump is connected downstream to the hydraulic medium filter via a first hydraulic line and the hydraulic medium filter is located between the pressure side of the pendulum slide cell pump and the hydraulic reservoir, and the control valve is pressure-connected to the hydraulic line upstream of the hydraulic medium filter.

11. The system according to claim 10, wherein the pendulum slide cell pump and the control valve are a common assembly.

12. The system according to claim 10, further comprising a hydraulic reservoir connected to an intake side of the pendulum slide cell pump via a suction line.

13. The system according to claim 12, wherein the first pressure-setting chamber is hydraulically connected to the pressure side of the pendulum slide pump and hydraulically counteracts the spring device; and the control valve is configured as a 3/2-way valve including:

a first connection hydraulically connected to the pressure side of the pendulum slide cell pump upstream of the hydraulic medium filter;

a second connection hydraulically connected to the second pressure-setting chamber; and a third connection hydraulically connected to the hydraulic reservoir.

14. The system according to claim 12, wherein the second pressure-setting chamber is hydraulically connected to the pressure side of the pendulum slide cell pump and hydraulically counteracts the spring device; and the control valve is configured as a 3/2-way valve including:

a first connection hydraulically connected to the pressure side of the pendulum slide cell pump upstream of the hydraulic medium filter;

a second connection hydraulically connected to the first pressure-setting chamber; and a third connection hydraulically connected to the hydraulic reservoir.

15. The system according to claim 12, wherein the control valve is a regulating piston valve; and further including an external control valve configured as a 3/2-way valve including:

a first connection hydraulically connected to the pressure side of the pendulum slide cell pump downstream of the hydraulic medium filter;

a second connection hydraulically connected to the regulating piston; and a third connection hydraulically connected to the hydraulic reservoir.

16. The system according to claim 15, wherein the regulating piston has a plurality of connections including:

a first connection hydraulically connected to the pressure side of the pendulum slide cell pump upstream of the hydraulic medium filter;

a second connection connected to the first pressure-setting chamber and a third connection connected to the second pressure-setting chamber; and a fourth connection and a fifth connection each connected to the second connection of the external control valve.

17. The system according to claim 10, wherein the actuation member includes a stator, the outer rotor being arranged rotatably within the stator, and wherein the stator is adjustably mounted in a housing in a pivotable manner about a pivot axis, the pivot axis extending parallel and eccentrically to a rotation axis of the inner rotor, and the rotation axis being arranged in a stationary relationship with respect to the housing.

18. The system according to claim 17, wherein at least one of:

the first pressure-setting chamber is arranged in the housing proximally to the pivot axis;

the second pressure-setting chamber is arranged in the housing distally from the pivot axis; and the spring device is arranged in the housing distally from the pivot axis.

19. The system according to claim 10, wherein the actuation member includes a stator and the outer rotor is disposed within the stator.

20. The system according to claim 13, wherein the hydraulic reservoir is connected via a second hydraulic line to the intake side and without passing through a filter.

* * * * *